US005317761A

United States Patent [19]

Piche

[11] Patent Number: 5,317,761

[45] Date of Patent: Jun. 7, 1994

[54] SELF-ADHERING ABSORBENT DISPOSABLE PADS FOR HEADWEAR

[76] Inventor: Bradley Piche, 65 Harris Ave., Clarendon Hills, Ill. 60514

[21] Appl. No.: 867,350

[22] Filed: Apr. 13, 1992

[51] Int. Cl.[5] ..... A42C 5/02

[52] U.S. Cl. ..... 2/181; 2/181.4; 2/DIG. 11

[58] Field of Search ..... 2/60, 63, 181, 181.4, 2/185 R, 190, 199, DIG. 11, 181.2, 182.2, 183, 197

[56] References Cited

U.S. PATENT DOCUMENTS

| | | | |
|---|---|---|---|
| 1,986,312 | 1/1935 | Wilson | 2/63 |
| 2,003,886 | 6/1935 | Hoffeld | 2/181 |
| 4,502,156 | 3/1985 | Wishman | 2/181 |
| 4,546,215 | 10/1985 | Ferraro | 179/156 R |
| 4,653,119 | 3/1987 | Kaiser | 2/60 |
| 4,654,898 | 4/1987 | Ishikawa | 2/209 |
| 4,941,210 | 7/1990 | Konucik | 2/181.4 |
| 4,947,488 | 8/1990 | Ashinoff | 2/181 |
| 4,949,404 | 8/1990 | Fekete | 2/410 |
| 5,022,095 | 6/1991 | Fleury | 2/190 |
| 5,025,504 | 6/1991 | Benston | 2/181.4 |
| 5,088,126 | 2/1992 | Mathis | 2/181 |
| 5,101,516 | 4/1992 | Scarnato | 2/DIG. 11 |

*Primary Examiner*—Clifford D. Crowder
*Assistant Examiner*—Diana L. Biefeld
*Attorney, Agent, or Firm*—Patula & Associates

[57] ABSTRACT

A disposable device for absorbing perspiration that can be placed into the forehead area of a variety of styles and sizes of headwear. The invention consists of a flexible, liquid absorbent pad made from a material such as cloth having an absorbent nap, such as terry cloth, or absorbent paper, which may be cut by the user to fit the forehead area of the headwear. The absorbent pad may be of varying degrees of thickness. The absorbent pad is coated on one side with an adhesive, which temporarily but firmly adheres the absorbent pad to the headwear. After the absorbent pad becomes soiled, the invention can be removed from headwear by the user, disposed of, and replaced with a new absorbent pad. The non-adhesive side of the absorbent pad may be readily printable, so that advertising, slogans or other messages may be printed thereon.

11 Claims, 3 Drawing Sheets

SELF-ADHERING ABSORBENT DISPOSABLE PADS FOR HEADWEAR

FIELD OF THE INVENTION

This invention teaches a sanitary, disposable device for absorbing perspiration and dirt that can be fit by the user into a variety of styles and sizes of headwear.

BACKGROUND OF THE INVENTION

It is frequently the case that during exercise or other physical exertion, an individual will perspire around the forehead area. If the individual is wearing a hat, cap or other type of headwear, then the perspiration from the forehead area will soil the headwear, making the headwear unsanitary, particularly if the individual is wearing cosmetic preparations or suntan oil. The present invention solves this problem by teaching a device which absorbs perspiration, or other fluids, thus keeping the headwear clean. The invention can be placed in virtually any type of headwear, and removed and disposed of after the invention becomes soiled. Moreover, because the invention can be placed in the forehead area of the headwear, it serves the additional function of preventing perspiration from dripping onto the user's face, and into the users eyes. This is important if the user is participating in a sport requiring hand-eye coordination such as baseball, golf, football, tennis, etc. where perspiration in the users eyes can cause a temporary blindness and consequent loss of performance. This function of the invention is even more important if user is operating heavy equipment, where a temporary loss of sight can be a serious safety hazard.

BRIEF SUMMARY OF THE INVENTION

The invention is a disposable device for absorbing perspiration that can be placed into the forehead area of a variety of styles and sizes of headwear. The invention consists of a flexible, liquid absorbent pad made from a material such as cloth having an absorbent nap, such as terry cloth, or absorbent paper, which may be cut by the user to fit the forehead area of the headwear. The absorbent pad may be of varying degrees of thickness. For example, the thickness of the absorbent pad at its midpoint could be greater than the thickness of the absorbent pad at its ends. Alternatively, the thickness of the absorbent pad at its midpoint could be less than the thickness of the absorbent pad at its ends. In either case, the thickness of the absorbent pad would not be constant. The absorbent pad is coated on one side with an adhesive, which temporarily but firmly adheres the absorbent pad to the headwear. After the absorbent pad becomes soiled, the invention can be removed from headwear by the user, disposed of, and replaced with a new absorbent pad. The non-adhesive side of the absorbent pad may be readily printable, so that advertising, slogans or other messages may be printed thereon.

It is the principle object of this invention to provide a sanitary, economical and disposable device that can be placed in headwear, which absorbs perspiration, suntan oils, sun block, or cosmetic preparations.

It is also an object of this invention to provide a device for absorbing perspiration that can be adjusted to fit in a variety types and sizes of headwear.

It is an additional object of the invention to help keep headwear from becoming soiled.

It is another object of the invention to prevent perspiration or other body fluids from dripping into a users eyes.

It is a further object of the invention to improve the safety for persons who perspire heavily during exercise or work, by preventing perspiration or other body fluids, or suntan oils, sun block, cosmetic preparations from dripping into the users eyes.

Numerous other advantages and features of the invention will become readily apparent from the detailed description of the preferred embodiment of the invention, from the claims, and from the accompanying drawings, in which like numerals are employed to designate like parts throughout the same.

BRIEF DESCRIPTION OF THE DRAWINGS

A fuller understanding of the foregoing may be had by reference to the accompanying drawings, wherein.

DESCRIPTION OF THE PREFERRED EMBODIMENT

Figure 1:
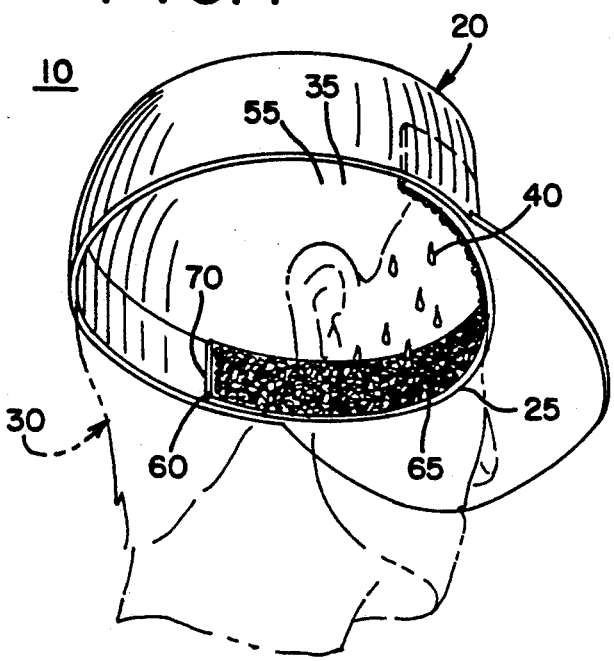
FIG. 1 is a perspective view of the preferred embodiment of the present invention in the environment.

While the invention is susceptible of embodiment in many different forms there is shown in the drawings and will be described herein in detail, preferred and alternate embodiments of the invention. It should be understood, however, that the present disclosure is to be considered an exemplification of the principles of the invention and is not intended to limit the spirit and scope of the invention and/or claims of the embodiments illustrated.

Referring now to the drawings, FIG. 1 shows the preferred embodiment of the present invention 10 disposed on headwear 20, on the headwear 20 which is worn on human head 30. The headwear 20 as shown in FIG. 1 is a typical baseball cap, but the invention 10 will work equally well on any other type of headwear. The invention 10 is disposed on forehead area 25 of headwear 20, and absorbs perspiration 40, dripping from the top 35 of human head 30. The invention 10 may be of sufficient size to extend from the left temple (not shown) of the human head 30 to the right temple 55 of human head 30. The invention 10 has absorbent pad 60 having midpoint 65 and adhesive 70.

Figure 2:
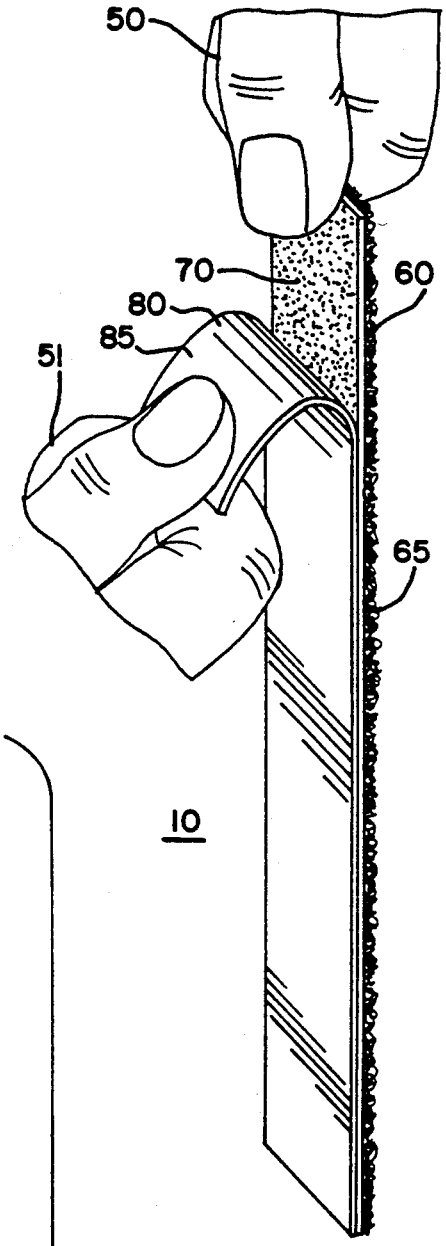
FIG. 2 is a perspective view of the preferred embodiment of the invention of FIG. 1.

FIG. 2 shows the preferred embodiment of the invention 10 before it is applied to the headwear 20. Human hands 50 and 51 grasp the invention 10 as shown, one hand 50 grasping absorbent pad 60, the other hand 51 grasping adhesive back 80. Downward force is applied by hand 51, peeling the adhesive back 80 from the adhesive 70, the adhesive 70 remaining on absorbent pad 60. Absorbent pad 60 has midpoint 65.

Absorbent pad 60 can be made of a terry cloth type material, or paper, or any other type of flexible material that absorbs perspiration, or other fluids, such as fluids applied to the body, i.e., suntan oil, sun block or cosmetic preparations. Absorbent pad 60 can also vary in thickness, and is likely to be substantially rectangular in configuration, although other embodiments may be of square, circular, or any other shape. The non-adhesive side of the absorbent pad 60 may be readily printable, so that advertising, slogans or other messages may be printed thereon. The adhesive 70 is a contact type of adhesive, but may also be double-sided tape, which will not permanently adhere the invention 10 to the headwear 20, but will still hold the invention 10 firmly in place on the headwear 20. Adhesive back 80 is made of paper, plastic, cloth, or any other flexible material. The surface 85 of adhesive back 80 that comes into contact with the adhesive 70 may be treated so that when the adhesive back 80 is pulled away from the adhesive 70 and absorbent pad 60, the adhesive 70 remains on absorbent pad 60.

Figure 3:
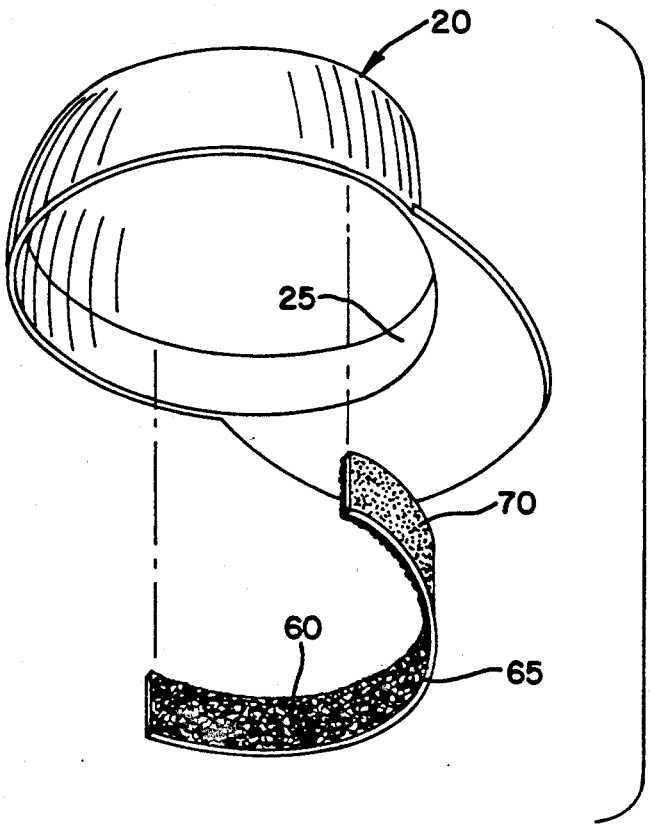
FIG. 3 is a perspective view of the preferred embodiment of the invention of FIG. 1 in the environment.

FIG. 3 shows the preferred embodiment of the invention 10, consisting of absorbent pad 60 having midpoint 65 and adhesive 70, after it is cut to the appropriate size and the adhesive back 80 removed, being inserted onto the forehead area 25 of headwear 20. The invention 10 is oriented so that the side of the absorbent pad 60 having the adhesive 70 will come into contact with the forehead area 25 of headwear 20.

Figure 4:
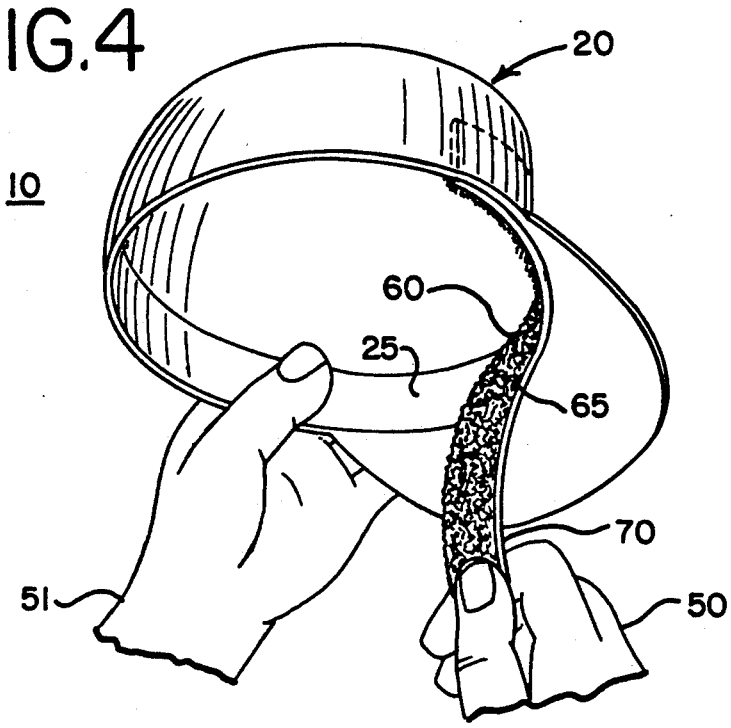
FIG. 4 is a perspective view of the preferred embodiment of the invention of FIG. 1 in the environment.

FIG. 4 shows the preferred embodiment of the invention 10, having absorbent pad 60 having midpoint 65 and adhesive 70 being removed from the headwear 20. Hand 51 firmly grasps the headwear 20 as shown. Hand 50 grasps the invention 10 and pulls it from the forehead area 25 of headwear 20. The invention 10 can then be disposed of and a new absorbent pad 60 inserted in the forehead area 25 of headwear 20.

Figure 5:
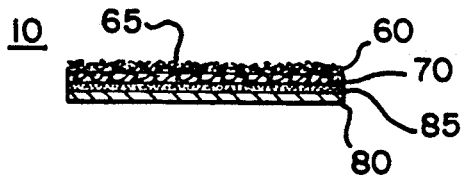
FIG. 5 is a front view of the preferred embodiment of the invention of FIG. 1.

FIG. 5 is a side view of the preferred embodiment of the invention 10, showing the absorbent pad 60 having midpoint 65, the adhesive 70, and adhesive back 80, with side 85 of adhesive back 80 coming into contact with adhesive 70.

Figure 6:
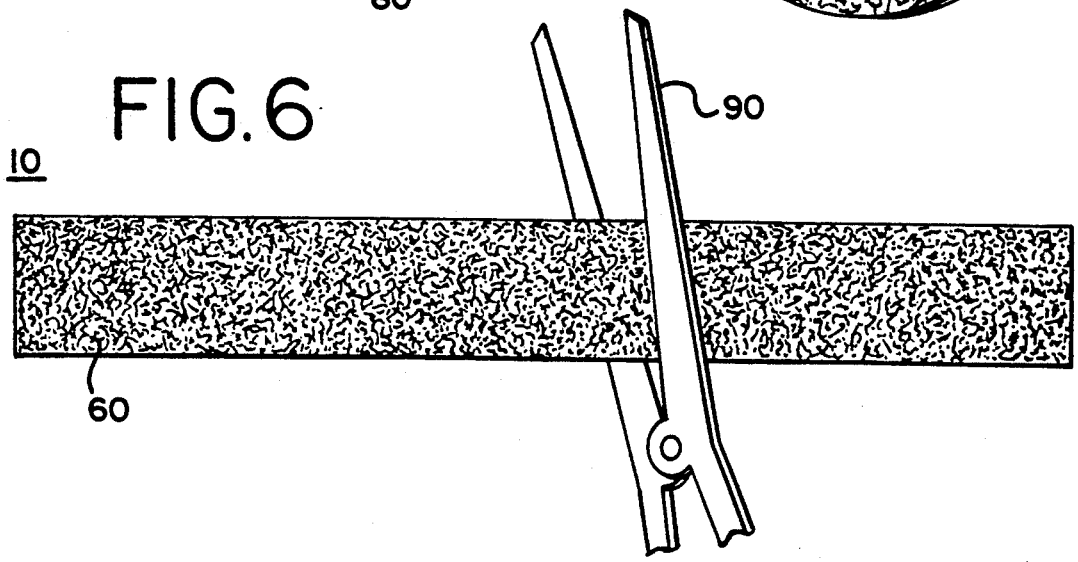
FIG. 6 is a top view of the preferred embodiment of the invention of FIG. 1.

FIG. 6 is a top view of the invention 10 showing absorbent pad 60. The invention 10 is being cut by scissors 90 so that it may properly fit into headwear 20.

Figure 7:
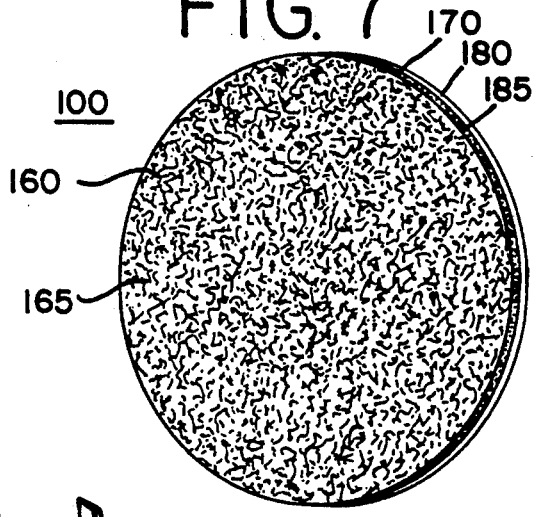
FIG. 7 is a perspective view of an alternate embodiment of the invention.

FIG. 7 is alternate embodiment of the invention 100, which is substantially the same as the preferred embodiment of the invention 10, but is circular in shape rather than rectangular in shape as is the preferred embodiment 10. The alternate embodiment 100 has absorbent pad 160 having midpoint 165, adhesive 170, and adhesive back 180, with side 185 of adhesive back 180 coming into contact with adhesive 170. The alternate embodiment is circular to accommodate a variety of earwear.

To operate the invention, the operator first cuts the invention 10 to the appropriate length as illustrated in FIG. 6.

Figure 8:
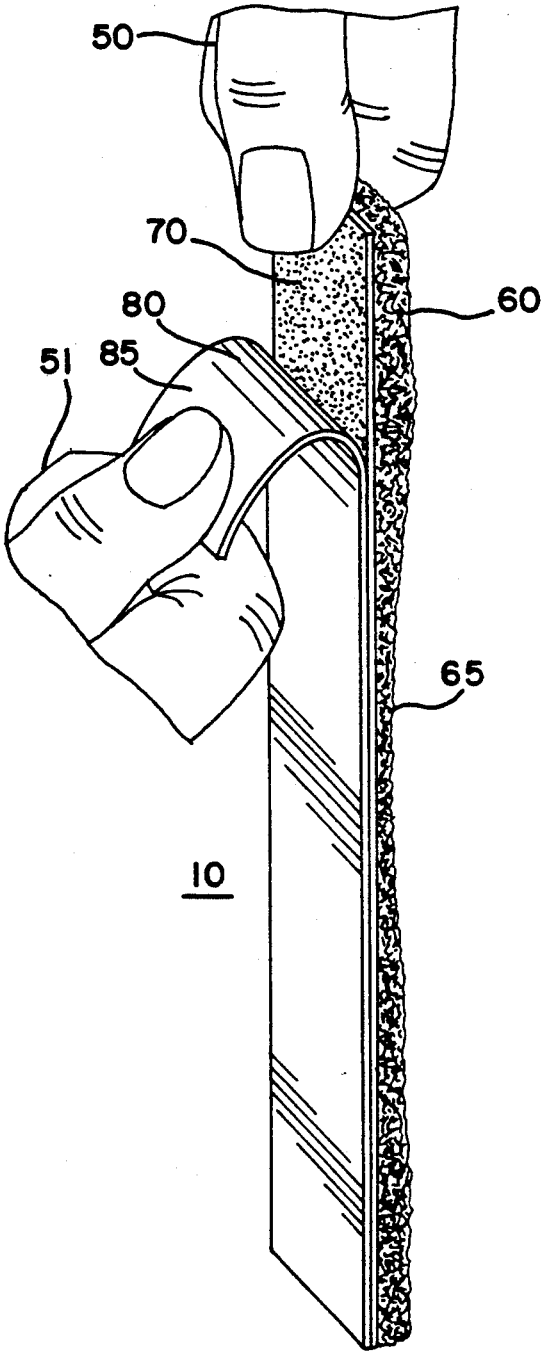
FIGS. 8 and 9 are perspective view of alternative embodiments of the invention of FIG. 1.
Figure 9:
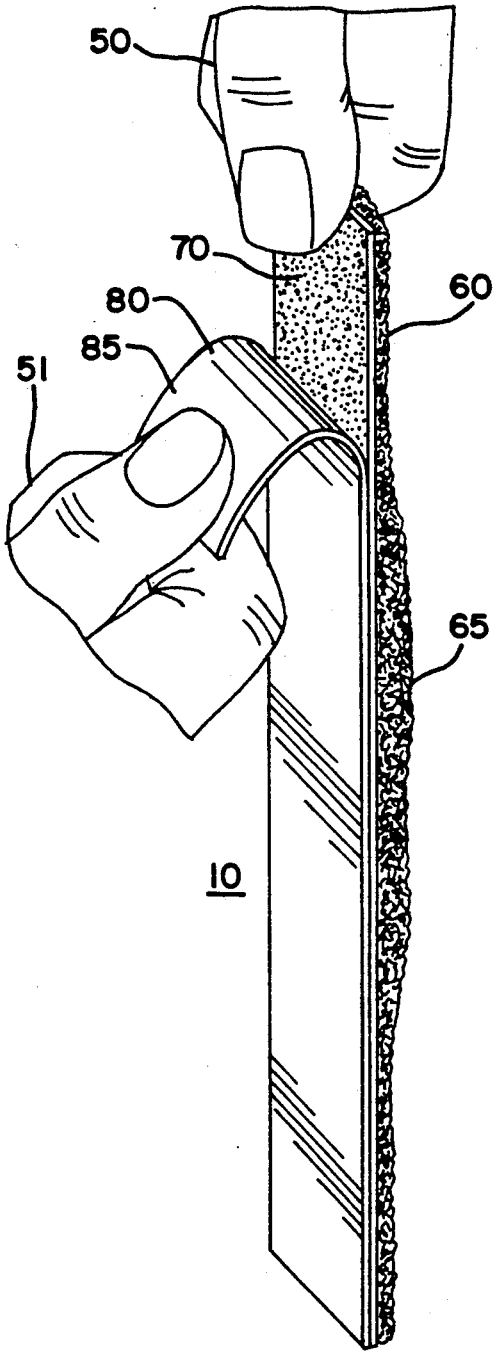

FIGS. 8 and 9 show alternative embodiments of the invention wherein the midpoint 65 is either thicker or thinner at the midpoints 65 of absorbent pad 60. It is recommended that the invention be cut to a length that will fit from "temple-to-temple" on the headwear 20, but shorter or longer lengths will serve as well. Moreover, the user of the invention 10 may cut the invention 10 in any manner, which may facilitate the use of the invention 10, such as cutting the invention 10 into multiple pieces, or cutting holes in the invention 10 to avoid aberrations which exist in the construction of the headwear 20. After the invention 10 is properly cut, the user, as illustrated in FIG. 2, peels the adhesive back 80 from the adhesive 70, to expose the adhesive 70 which is attached to absorbent pad 60. The invention 10 is then oriented so that adhesive 70 is facing the forehead area 25 of the headwear 20, and the invention is then pressed onto forehead area 25. (See FIG. 3). The headwear 20 with the invention 10 may then be worn as illustrated in FIG. 1.

After the invention 10 becomes soiled from use, the invention 10 may be removed from the headwear 20. Because the adhesive 70 does not permanently affix the invention 10 to the forehead area 25 of the headwear 20, it may be easily removed from the headwear 20 by grasping a portion of the invention 10 and simply pulling the invention 10 from the headwear 20. The soiled invention 10 may then be disposed of, and a new absorbent pad 60 with adhesive 70 put into the headwear 20 as previously described.

The foregoing specification describes only the preferred embodiment and the alternate embodiment of the invention as shown. Other embodiments, for example, such as absorbent pads of different shapes, may be articulated as well. The terms and expressions therefore serve only to describe the invention by example only and not to limit the invention. It is expected that others will perceive differences which while differing from the foregoing, do not depart from the spirit and scope of the invention herein described and claimed.

What I claim is:

1. A self-adhering, absorbent, removably disposable, adjustable pad for headwear, comprising:

flexible material means for absorbing fluids having first and second sides, first and second ends, and a midpoint between said first and second ends, and the thickness of said absorbing means at said midpont is greater than the thickness of said absorbing means for absorbing is not constant, thereby providing greater absorption at said midpoint than at said first and second ends; and means for adhering said absorbing means to the headwear, said adhering means disposed on said first side of said absorbing means, said adhering means has first and second sides, said first side of said adhearing means disposed on said first side of said absorbing means, said second side of said adhering means having a paper means for covering said adhering means disposed thereon.

said second side of said absorbing means being in direct contact with a wearer's forehead area when in use.

2. A self-adhering, absorbent, removably disposable, adjustable pad for headwear, comprising:

flexible material means for absorbing fluids having first and second sides, first and second ends, and a midpoint between said first and second ends, and the thickness of said absorbing means at said midpoint is less than the thickness of said absorbing means at said first and second ends such that the thickness of said means for absorbing is not constant, thereby providing greater absorption at said first and second ends than at said midpoint; and means for adhearing said absorbing means to the headwear, said adhering means disposed on said first side of said absorbing means, said adhering means has first and second sides, said first side of said adhering means disposed on said first side of said absorbing means, said second side of said adhering means having a paper means for covering said adhering means disposed thereon, said second side of said absorbing means being in direct contact with a wearer's forehead area when in use.

3. A self-adhering, absorbent, removably disposable, adjustable pad for headwear, comprising:

flexible material means for absorbing fluids having first and second sides, first and second ends, and a midpoint between said first and second ends, and the thickness of said absorbing means at said midpoint is greater than the thickness of said absorbing means at said first and second ends such that the thickness of said means for absorbing is not constant so as to provide greater absorption at a central forehead area of a wearer;

means for adhering said absorbing means to the headwear, having first and second sides, said first side of said adhering means disposed on said first side of said absorbing means, said second side of said absorbing means being exposed so that said absorbing means directly contacts a forehead area of a wearer; and paper means for covering said adhering means, said paper covering means disposed on said second side of said adhering means.

4. A self-adhering, absorbent, removably disposable, adjustable pad for headwear, comprising:

flexible material means for absorbing fluids having first and second sides, first and second ends, and a midpoint between said first and second ends, and the thickness of said absorbing means at said midpoint is less than the thickness of said absorbing means said first and second ends such that the thickness of said means for absorbing is not constant so as to provide greater absorption at each temple area of a wearer;

means for adhering said adsorbing means to the headwear, having first and second sides, said first side of said adhering means disposed on said first side of said absorbing means, said second side of said absorbing means being exposed so that said absorbing means directly contacts a forehead area of a wearer; and paper means for covering said adhering means, said paper covering means disposed on said second side of said adhering means.

5. The pad of claim 2, 3, or 4, wherein said absorbing means is continuous from a wearer's left temple to forehead to right temple and is readily physically conformed to avoid aberrations in the headwear to accommodate a forehead area of the headwear and to comfortably fit the forehead area of a wearer.

6. The pad of claim 1, 2, 3, or 4, wherein said absorbing means is constructed of an absorbent cotton material.

7. The pad of claim 1, 2, 3 or 4, wherein said adhering mean sis a contact type cement.

8. The pad of claim 1, 2, 3 or 4, wherein said absorbing means is rectangular in configuration.

9. The pad of claim 1, 2, 3, or 4, wherein said absorbing means is circular in configuration.

10. The pad of claim 1, 2, 3, or 4, wherein said absorbing means is constructed of an absorbent paper material.

11. The pad of claim 1, 2, 3, or 4, wherein said adhering means is double-sided adhesive tape.

* * * * *